US008687952B2

(12) United States Patent
Park et al.

(10) Patent No.: US 8,687,952 B2
(45) Date of Patent: Apr. 1, 2014

(54) HEATING APPARATUS

(75) Inventors: Man Uk Park, Seoul (KR); Seong Won Park, Seoul (KR)

(73) Assignee: Woongjin Coway Co., Ltd., Yougu-Eup, Gongjoo, Choongcheongnam-Do (KR)

( * ) Notice: Subject to any disclaimer, the term of this patent is extended or adjusted under 35 U.S.C. 154(b) by 0 days.

(21) Appl. No.: 12/922,642

(22) PCT Filed: Jul. 8, 2010

(86) PCT No.: PCT/KR2010/004449

§ 371 (c)(1),
(2), (4) Date: Sep. 14, 2010

(87) PCT Pub. No.: WO2011/052874

PCT Pub. Date: May 5, 2011

(65) Prior Publication Data

US 2012/0201525 A1 Aug. 9, 2012

(30) Foreign Application Priority Data

Oct. 30, 2009 (KR) ..... 10-2009-0104563

(51) Int. Cl.
*F24H 1/10* (2006.01)

(52) U.S. Cl.
USPC ..... 392/478

(58) Field of Classification Search
USPC ..... 392/454, 478, 483–487, 491–494; 219/628
See application file for complete search history.

(56) References Cited

U.S. PATENT DOCUMENTS

| | | | | | |
|---|---|---|---|---|---|
| 4,638,147 | A * | 1/1987 | Dytch et al. | ..... | 392/485 |
| 5,216,743 | A * | 6/1993 | Seitz | ..... | 392/490 |
| 5,438,642 | A * | 8/1995 | Posen | ..... | 392/485 |
| 5,729,653 | A * | 3/1998 | Magliochetti et al. | ..... | 392/485 |
| 6,246,831 | B1 * | 6/2001 | Seitz et al. | ..... | 392/486 |
| 6,327,718 | B1 * | 12/2001 | Ono et al. | ..... | 4/420.2 |
| 6,748,646 | B2 * | 6/2004 | Von Arx et al. | ..... | 29/613 |
| 7,177,536 | B2 * | 2/2007 | Natsuhara et al. | ..... | 392/479 |
| 2010/0296800 | A1 | 11/2010 | Min et al. | | |

FOREIGN PATENT DOCUMENTS

| | | | |
|---|---|---|---|
| JP | 2007-032273 | A | 2/2007 |
| KR | 20-0269038 | Y1 | 3/2002 |
| KR | 2005-0034779 | A | 4/2005 |
| KR | 10-0880773 | B1 | 2/2009 |

OTHER PUBLICATIONS

PCT International Search Report for PCT/KR2010/04449, dated Feb. 25, 2011.

* cited by examiner

*Primary Examiner* — Geoffrey S Evans
*Assistant Examiner* — Brandon Harvey
(74) *Attorney, Agent, or Firm* — Dority & Manning, P.A.

(57) ABSTRACT

A heating apparatus includes a ceramic heater including a plurality of ceramic plates having a plate shape, and a housing including an inlet hole and an outlet hole, the housing in which the ceramic heater is installed. The ceramic plates are disposed vertically in the housing in a parallel manner and the outlet hole is disposed in an upper portion of the housing, such that when a fluid flows through a flow path formed along the ceramic plates, bubbles, generated by the fluid heated by the ceramic plates, ascend toward edges of the ceramic plates.

9 Claims, 7 Drawing Sheets

PRIOR ART
(a)

PRIOR ART
(b)

HEATING APPARATUS

CROSS REFERENCE TO RELATED APPLICATIONS

This application is the U.S. National Stage entry of International Application Number PCT/KR2010/004449 filed wider the Patent Cooperation Treaty having a filing date of Jul. 8, 2010, which claims filing benefit of Korean Patent Application Serial Number 10-2009-0104563 having a filing date of Oct. 30, 2009.

BACKGROUND OF THE INVENTION

1. Field of the Invention

The present invention relates to a heating apparatus including a ceramic heater.

2. Description of the Related Art

FIG. 1A is a cross-sectional view illustrating a heating apparatus including a ceramic heater according to the related art, and FIG. 1B is a perspective view illustrating a ceramic heater according to the related art.

Referring to FIGS. 1A and 1B, a heating apparatus 1 includes a housing 10, a ceramic heater 20 installed inside the housing 10, and a fixing member 30 fixing the ceramic heater 20 to the housing 10.

The housing 10 and the ceramic heater 20 have cylindrical shapes and are disposed coaxially in general. The fixing member 30 has an inlet hole communicating with the inner space of the ceramic heater 20, and the housing 10 has an outlet hole. Accordingly, water introduced through the inlet hole passes through the inner space of the ceramic heater 20, flows along the outside space of the ceramic heater 20, and is discharged through the water outlet. Water, when flowing through the inner space of the ceramic heater 20, is heated by contacting the inner wall of the ceramic heater 20. When flowing through the outside space of the ceramic heater 20, the water is heated by contacting the outer wall of the ceramic heater 20. The water heated in the above manner is discharged through the outlet hole.

However, as shown in FIG. 1B, a heating wire 22, installed inside the ceramic heater 20 according to the related art, is placed adjacent to the outer wall of the ceramic heater 20. For this reason, water is heated mostly by the outer wall, while the inner wall rarely contributes to heating water. Thus, water introduced into the heating apparatus 1 is heated mostly when flowing through the outside space of the ceramic heater 20. This substantially reduces the time for which water is heated. In order to acquire warm water of high temperature, high power needs to be applied to the heating wire 22 of the ceramic heater 20, which is undesirable in terms of energy efficiency.

In this regard, Korean Patent Registration No. 0880773 suggests a fluid heating apparatus ensuring enhanced heating efficiency. As for the concrete construction thereof, the fluid heating apparatus includes flat ceramic heaters 102, spacer plates 105, channel forming plates 106, an upper cover 111 and a lower cover 113. The flat ceramic heaters 102 each have a terminal lead line 101 for power application. The spacer plates 105 are respectively disposed on and under the ceramic heater 102 in such a manner as to provide horizontal fluid paths. The horizontal fluid paths allow a fluid, which is to be heated, to flow toward the ceramic heater 102 while allowing a fluid heated by the ceramic heater 102 to be discharged. The channel forming plates 106 provide fluid channels such that a fluid, having passed through the horizontal fluid path, moves vertically toward the next fluid path. The upper cover 111 is coupled to the outer surface of the uppermost spacer plate 105 and has an inlet hole 110 through which a fluid to be heated is supplied. The lower cover 113 is coupled to the outer surface of the lowermost spacer plate 105 and has an outlet hole 112 through which a heated fluid is discharged.

According to the configuration suggested in the above document, the flat ceramic heater 102 is installed, and the spacer plates 105 and the channel forming plates 106 are disposed so as to form fluid paths on and under the ceramic heater 102. Accordingly, water introduced through the inlet hole 110 is instantaneously heated while contacting the upper and lower surfaces of the ceramic heater 120, and is then discharged through the outlet hole 112. By this construction, heat transfer occurs while water is in contact with a wide area of the flat ceramic heater 102, thereby enhancing heating efficiency.

However, the following limitations are present in the construction disclosed in the above-mentioned document where the flat ceramic heaters 102 are disposed horizontally and water is directed from the inlet hole 110 provided in the upper part toward the outlet hole 112 provided in the lower part.

FIG. 2 illustrates a flow path of the fluid heating apparatus configured as above. Referring to FIG. 2, it can be seen that water, introduced from the inlet hole 110 in the upper portion, passes through the flat ceramic heater 102 and is discharged through the outlet hole 112 provided in the lower portion. Water, when flowing along the upper surface of the ceramic heater 102, is heated by constantly contacting the ceramic heater 102. However, when flowing along the lower surface of the ceramic heater 102, water may not be in contact with the ceramic heater (See a portion indicated by a circle in the drawing). Of course, if a large amount of water is injected with high pressure, water may flow, fully occupying the entire flow path. However, if a small amount of water is provided or water pressure is low, water may not fully occupy the entire flow path. In that case, water, flowing through the flow path formed under the ceramic heater 102, may fail to contact the ceramic heater 102 as indicated by the circle in FIG. 2.

When water flows without making contact with the ceramic heater 102, the following limitations may arise.

First, water failing to contact the ceramic heater 102 wastes heat and degrades heating efficiency.

Secondly, in the flow path where water fails to contact the ceramic heater 102, air may come into contact with the ceramic heater 102 instead of water and be rapidly heated, thereby causing a drastic temperature change and accordingly thermal impact. Since the ceramic heater 102 is susceptible to thermal impact, a device may be easily damaged.

Thirdly, when a large amount of water is provided and water pressure is high, water flows while occupying the entire flow path to thereby increase heating efficiency. However, when a small amount of water is introduced and water pressure is low, water may not come into contact with a portion of the ceramic heater 102 to thereby degrade heating efficiency. For this reason, constant heating efficiency and accurate control may not be ensured.

Fourthly, even in the case in which a large amount of water is provided, water pressure is high and therefore water fully occupies the entire flow path, water heated by a heating surface, i.e., an increase in water temperature, may decrease the solubility of gases, dissolved in the water, and the gases are thus eluted. Accordingly, bubbles are generated, resulting in thermal impact. According to this document, the cross-section of a heating flow path is set to have a sufficiently great aspect ratio to prevent such thermal impact. In detail, the width of the heating flow path is made to be three times greater than the height thereof. Namely, the heating flow path has a flat shape, which is contributive to increasing the heating area per unit volume and thus increasing heating efficiency and flow rates. Accordingly, bubble absorption and bubble growth on the heating surface can be suppressed, thereby preventing the ceramic heater 102 from experiencing thermal impact. However, when the width of the heating path is increased, the width of the ceramic heater 102 is also increased; namely, a bigger ceramic heater 102 needs to be used. Using a bigger ceramic heater 102 may be contributive to preventing thermal impact resulting from bubble generation; however, it also increases unit volume and manufacturing costs.

Besides, this document discloses using a plurality of ceramic heaters 102. However, since the plurality of ceramic heaters 102 have the same calorific value, a waste of heat may occur to thereby degrade heating efficiency.

SUMMARY OF THE INVENTION

An aspect of the present invention provides a heating apparatus capable of heating water by making the water coming in contact with all of surfaces of a ceramic heater, thereby increasing heat transfer efficiency, preventing thermal impact caused by bubble generation and achieving precise temperature control.

According to an aspect of the present invention, there is provided a heating apparatus including: a ceramic heater including a plurality of ceramic plates having a plate shape; and a housing including an inlet hole and an outlet hole, the housing in which the ceramic heater is installed, wherein the ceramic plates are disposed vertically in the housing in a parallel manner and the outlet hole is disposed in an upper portion of the housing such that when a fluid flows through a flow path formed along the ceramic plates, bubbles, generated by the fluid heated by the ceramic plates, ascend toward edges of the ceramic plates.

The ceramic heater may include: a first ceramic plate disposed adjacent to the inlet hole; and a second ceramic plate disposed adjacent to the outlet hole, wherein a partition wall is installed between the first ceramic plate and the second ceramic plate.

The first ceramic plate and the second ceramic plate may be attached to one end portion of the housing and spaced part from the other end portion of the housing, and the partition wall may be attached to the other end portion of the housing and spaced apart from the one end portion.

The flow path may be widened from the inlet hole toward the outlet hole.

A gap may be formed between upper ends of the ceramic plates and the housing.

The outlet hole may be disposed higher than the inlet hole.

The ceramic plates may have an area that is greater than a cross-section of the flow path.

The ceramic plates may have an area that is greater than a cross-section of the flow path.

Heating wires may be installed inside the ceramic plates and disposed at the center of the ceramic plates in a thickness direction, respectively.

Power applied to the first ceramic plate may be different from power applied to the second ceramic plate.

The power applied to the second ceramic plate may be higher than the power applied to the first ceramic plate.

Fixed power applied to the first ceramic plate and variable power may be applied to the second plate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

Figure 1:
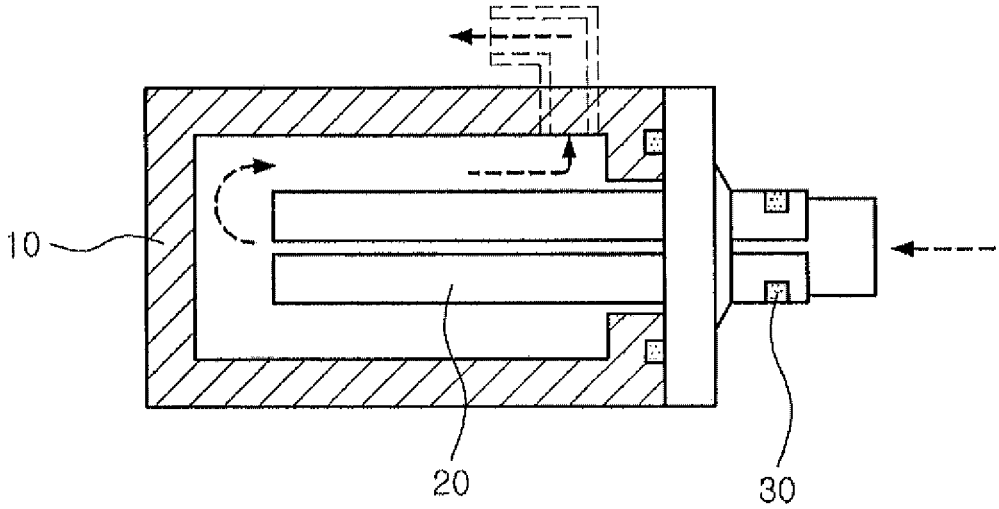
FIG. 1A is a cross-sectional view illustrating a heating apparatus including a ceramic heater according to the related art.
FIG. 1B is a perspective view illustrating a ceramic heater according to the related art.
Figure 1:
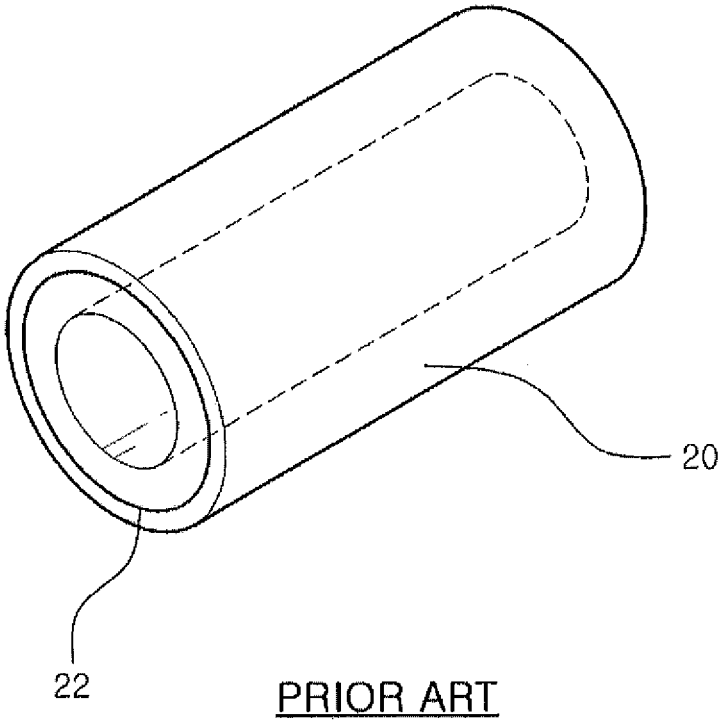
Figure 2:
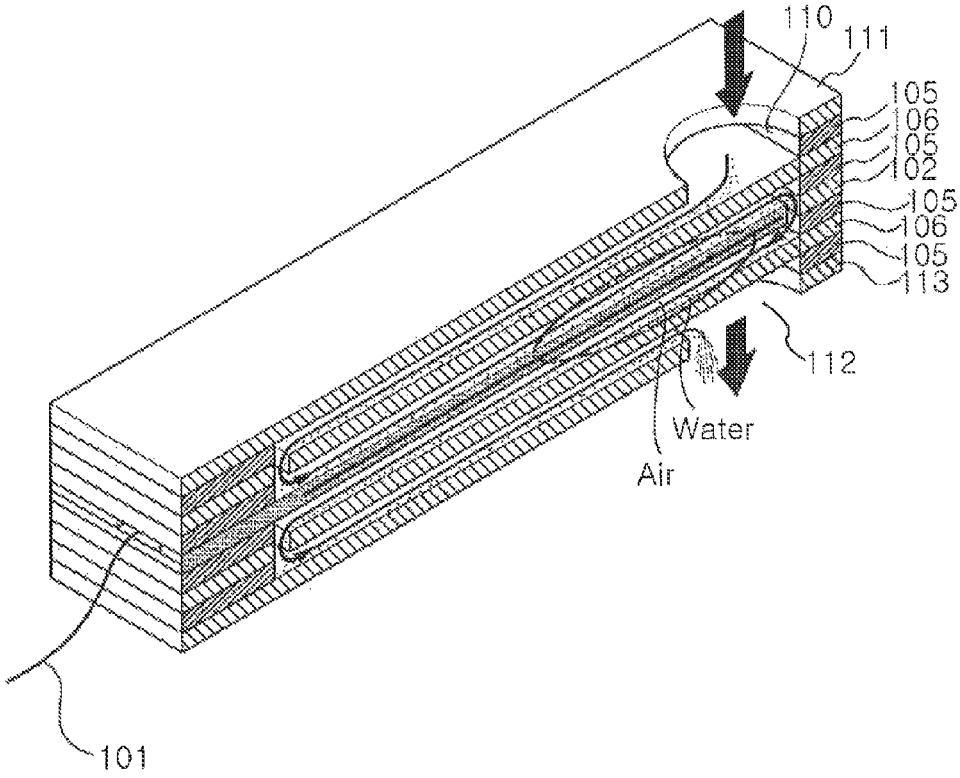
PRIOR ART FIG. 2
FIG. 2 is a perspective view illustrating a other ceramic heater according to the related art
Figure 3:
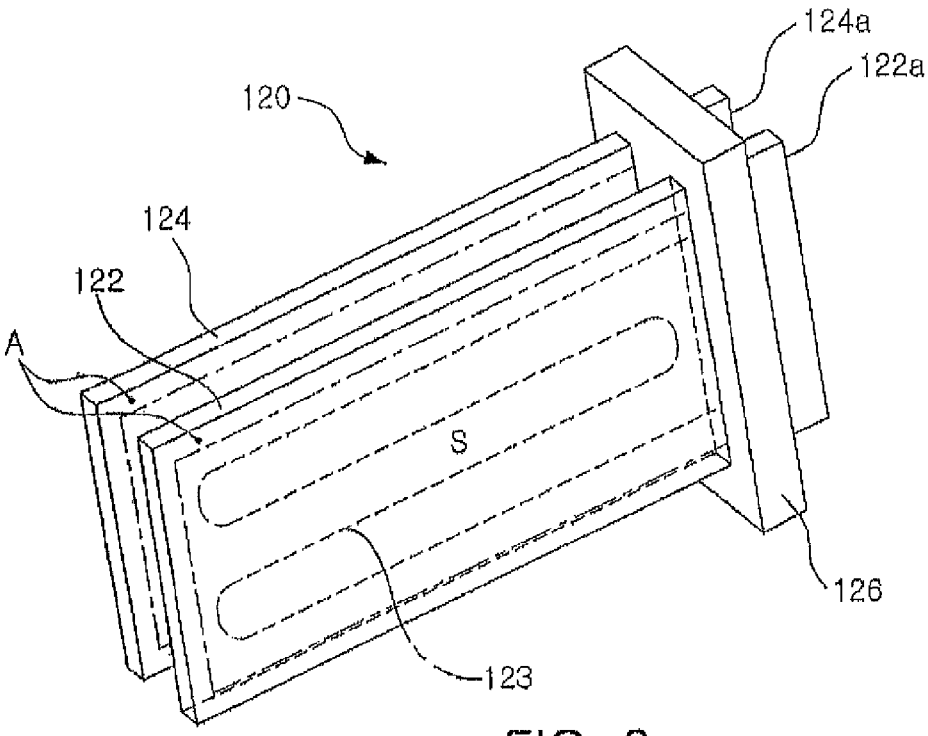
FIG. 3 is a perspective view illustrating a ceramic heater according to an exemplary embodiment of the present invention.

FIG. 3 is a perspective view illustrating a ceramic heater 120 according to an exemplary embodiment of the present invention.

Referring to FIG. 3, a ceramic heater 120 includes a first ceramic plate 122 and a second ceramic plate 124 disposed in parallel. The first ceramic plate 122 and the second ceramic plate 124 have the same plate shape. Heating wires 123 are disposed inside of the first and second ceramic plates 122 and 124, respectively. The heating wires 123 are respectively disposed at the center in a thickness direction of the first and second ceramic plates 122 and 124 to thereby evenly transfer heat, radiated from the heating wires 123, to both surfaces of the first and second ceramic plates 122 and 124.

The first and second ceramic plates 122 and 124 each have an edge region 'A' in which the heating wire 123 is absent. When a fluid flows, this edge region 'A', disposed along the edge of each of the ceramic plates 122 and 124, serves to prevent the ceramic plates 122 and 124 from being damaged by bubbles generated from the fluid heated by the ceramic plates 122 and 124.

Details of preventing damage to the first and second ceramic plates will be described later.

A fixing member 126 is installed at one side of the ceramic heater 120, and the two ceramic plates 122 and 124 may be fixed to the fixing member 126. This fixing member 126 may be coupled to one end portion of a housing 140 to be described later.

Terminals 122*a* and 124*a*, supplying power to the first and second ceramic plates 122 and 124, are installed on one side of the fixing member 126 opposite to the other side thereof to which the first and second ceramic plates 122 and 124 are fixed, respectively. These terminals 122*a* and 124*a* are connected to a controller (not shown) to thereby control power being supplied.

The ceramic plates 122 and 124 need to have an optimized thickness and interval therebetween since they directly affect the heating time and the performance of a heater.

The ceramic plates 122 and 124, when having a small thickness, may ensure a high heat transfer rate and a short heating time and thus become capable of heating water to a target temperature within a short period of time; however, they may experience the weakening of mechanical strength according to a temperature change. Therefore, it is difficult to make a heater employing such ceramic plates 122 and 124 into a product. In contrast, the ceramic plates 122 and 124, when having a large thickness, may lower the heat transfer rate, delay the heating time, and result in over-heating due to latent heat, generated by the saturated temperature of the surface of a heater, after power is cut off. According to an experiment concerning performance and safety, the appropriate thickness of the first and second ceramic plates 122 and 124 ranges from 1 mm to 3 mm.

As for the interval between the ceramic plates 122 and 124, if an interval between the two ceramic plates 122 and 124 is excessively small, the amount of fluid flowing between the ceramic plates 122 and 124 becomes insufficient, thereby failing to obtain a desired amount of warm water and increasing the possibility of problems caused by an excessive increase in temperature. On the other hand, an excessively wide interval between the ceramic plates 122 and 124 increases the amount of fluid flowing therebetween and thus causes a lack of heat quantity, thereby failing to meet desired performance. According to an experiment concerning performance and safety, the interval between the first and second ceramic plates 122 and 124 needs to be maintained in the range of 2 mm to 15 mm.

Figure 4:
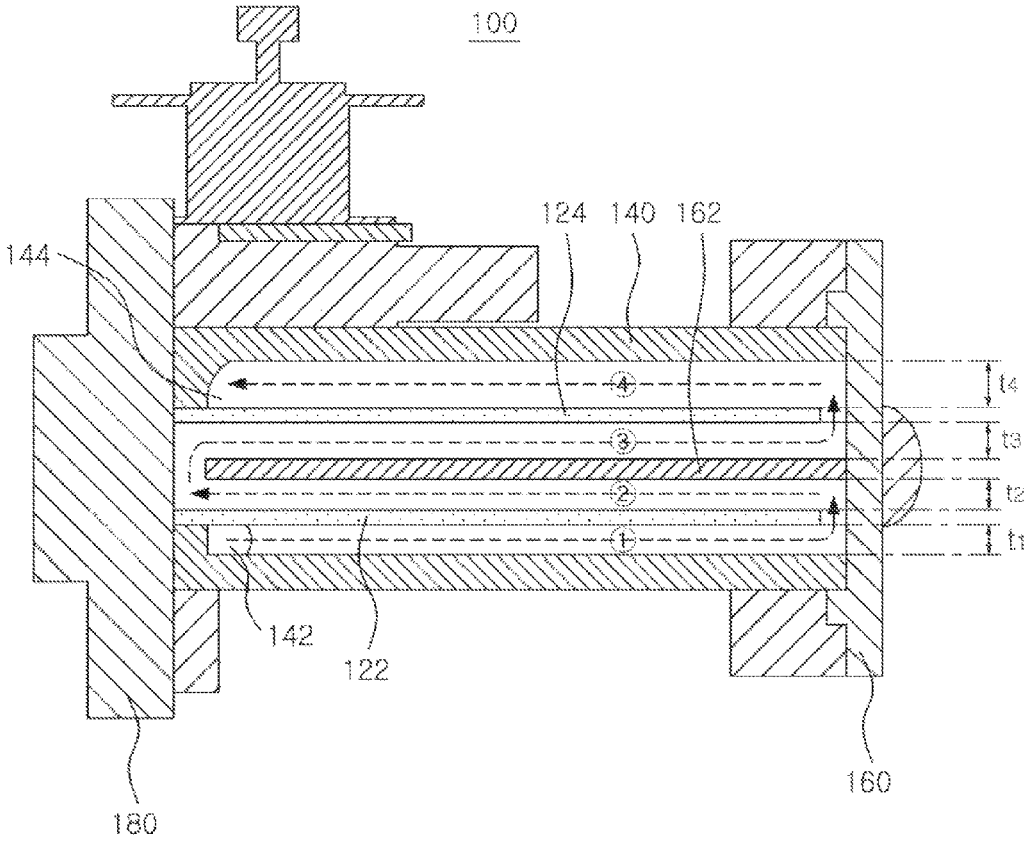
FIG. 4 is a cross-sectional view illustrating the top portion of a heating apparatus including a ceramic heater according to an exemplary embodiment of the present invention.
Figure 5:
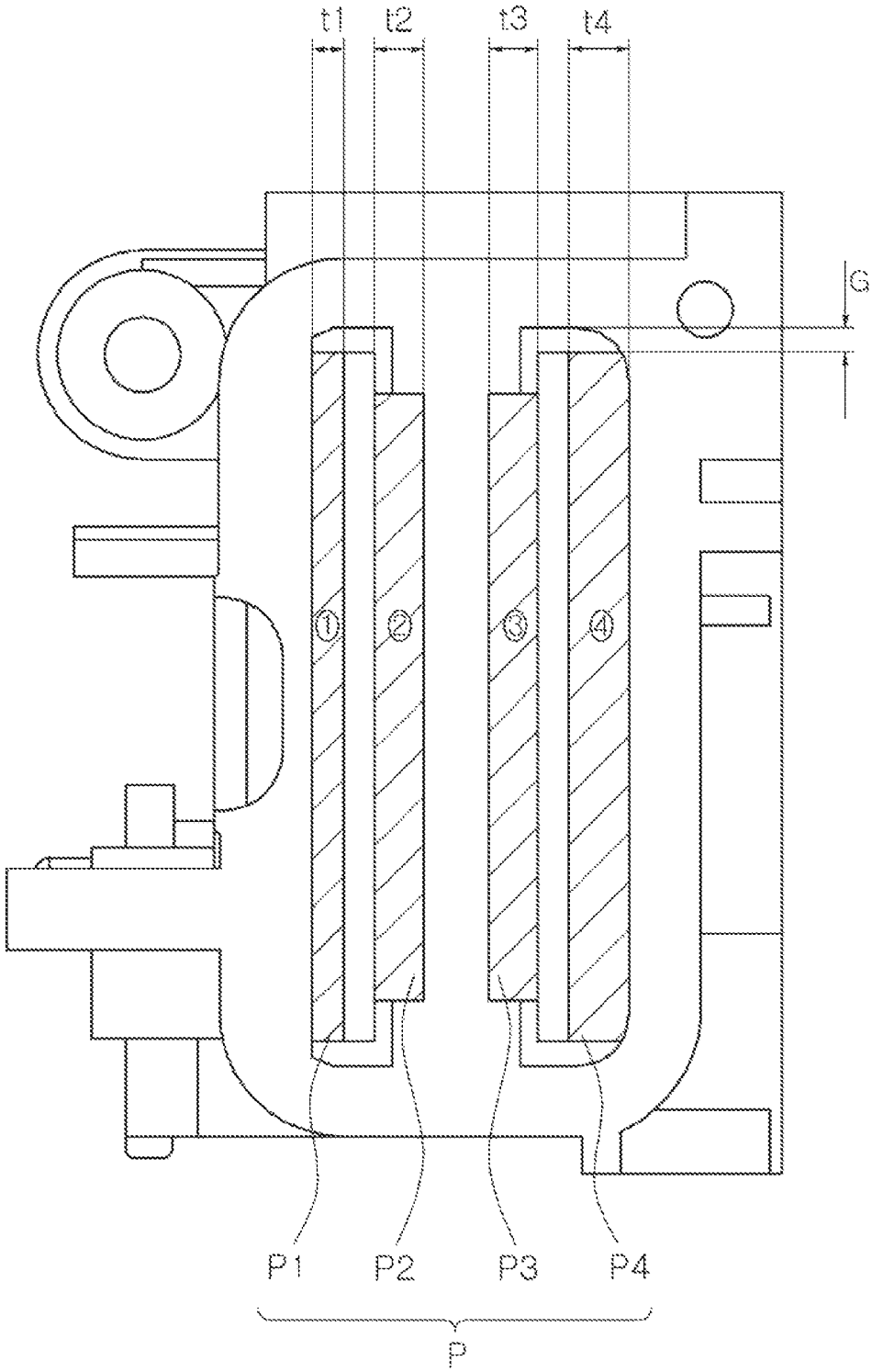
FIG. 5 is a cross-sectional view illustrating the front portion of a heating apparatus including a ceramic heater according to an exemplary embodiment of the present invention.

FIG. 4 is a cross-sectional view illustrating the top portion of a heating apparatus 100 including the ceramic heater 120 according to an exemplary embodiment of the present invention. FIG. 5 is a cross-sectional view illustrating the front portion of the heating apparatus 100 including the ceramic heater 120 according to an exemplary embodiment of the present invention, and FIG. 6 is a cross-sectional view illustrating the side portion of the heating apparatus 100 including the ceramic heater 120 according to an exemplary embodiment of the present invention.

Figure 6:
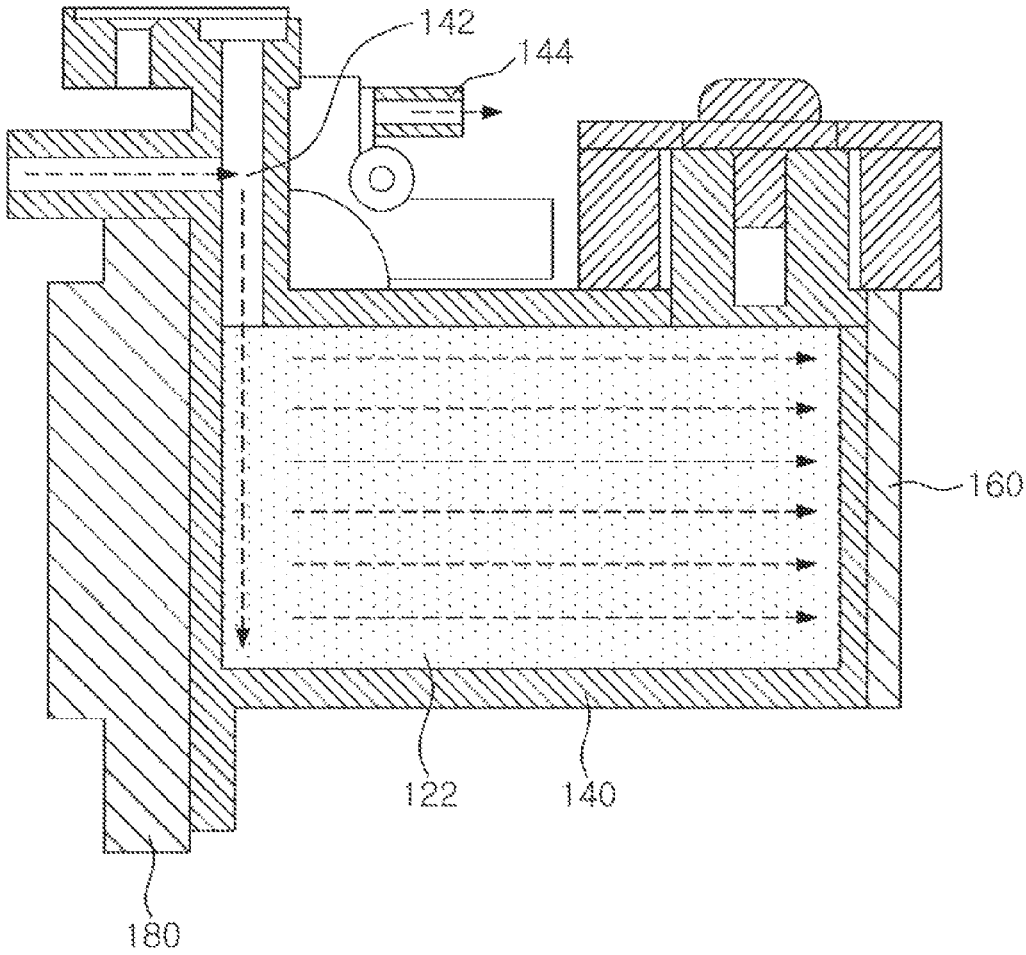
FIG. 6 is a cross-sectional view illustrating the side portion of a heating apparatus including a ceramic heater according to an exemplary embodiment of the present invention.

Referring to FIGS. 4 through 6, the heating apparatus 100 includes the ceramic heater 120, a housing 140, a cap member 160, and a bracket 180.

The fixing member 126 of the ceramic plates 122 and 124 is coupled to one end portion of the housing 140, thereby fixing the ceramic plates 122 and 124 to the inside of the housing 140. The bracket 180 may be coupled to the one end portion of the housing 140. The ceramic plates 122 and 124 have a smaller length than that of the housing 140. Thus, when the ceramic plates 122 and 124 are installed inside the housing 140, the end portions of the ceramic plates 122 and 124 are spaced apart from the cap member 160 to be described later, thereby allowing water to flow between the cap member 160 and the ceramic plates 122 and 124.

The cap member 160 is coupled to the other end portion of the housing 140. A partition wall 162 is attached to the cap member 160. When the cap member 160 is coupled to the other end portion of the housing 140, the partition wall 162 is disposed between the two ceramic plates 122 and 124. The partition wall 162 extends in the longitudinal direction of the housing 140 and divides the space between the ceramic plates 122 and 124. The partition wall 162 has a smaller length than that of the housing 140. Thus, when the partition wall 162 is installed inside the housing 140, the partition wall 162 is spaced apart from the one end portion of the housing 140. Accordingly, water can flow between the one end portion of the housing 140 and the partition wall 162.

The first and second ceramic plates 122 and 124 are placed in the upright position (i.e., vertically) within the housing 140 so as to be parallel to each other. That is, the plate-shaped ceramic plates 122 and 124 are installed vertically, and thus bubbles generated by the heating of the ceramic plates 122 and 124 can move upwards.

An inlet hole 142 and an outlet hole 144 are formed in the housing 140. The inlet hole 142 is formed in one side of the housing 140 where the first ceramic plate 122 is disposed, while the outlet hole 144 is formed in another side of the housing 140 where the second ceramic plate 124 is disposed. Also, the inlet hole 142 and the outlet hole 144 are provided toward the one end portion of the housing 140, that is, toward a side of the housing to which the fixing member 126 of the first and second ceramic plates 122 and 124 is coupled. The inlet hole 142 and the outlet hole 144 are disposed in the upper side of the housing 140. Since the outlet hole 144 is disposed in the upper side, water, heated inside the housing 140, can be pushed upwards and discharged.

The area of the ceramic plates 122 and 124 may be greater than the cross-section of a heating flow path. 'S' in FIG. 3 denotes the area of the ceramic plates 122 and 124 while 'P' in FIG. 5 denotes the cross-section of the heating flow path. P is the sum of cross-sections of flow paths ①, ②, ③ and ④. The area S of the ceramic plates is made to be greater than the cross-section P of the flow paths. Accordingly, water flowing through the flow path can receive sufficient heat from the ceramic plates.

An operational method of the heating apparatus 100, according to an exemplary embodiment of the present invention, will now be described.

As for a flow path, water, introduced into the inlet hole 142 of the housing 140, flows between the first ceramic plate 122 and one side surface of the housing 140. Here, water flows from the one end portion of the housing 140 (i.e., from the bracket 180) toward the other end portion (i.e., toward the cap member 160) (hereinafter, referred to as "flow path ①"). Water, when reaching the other end portion of the housing 140, switches direction through the space between the first ceramic plate 122 and the cap member 160. The direction-switched water flows between the first ceramic plate 122 and the partition wall 162. At this time, the water flows from the other end portion of the housing 140 toward the one end portion thereof (hereinafter, this flow referred to as "flow path ②"). The water, when reaching the one end portion of the housing 140, switches direction through the space between the fixing member 126 and the partition wall 162. The direction-switched water flows through the space between the second ceramic plate 124 and the partition wall 162. At this time, the water flows from the one end portion of the housing 140 toward the other end portion (hereinafter, referred to as "flow path ③"). The water, when reaching the other end portion of the housing 140, switches direction through the space between the second ceramic plate 124 and the cap member 160. The direction-switched water flows between the second ceramic plate 124 and the other side surface of the housing 140. At this time, the water flows from the other end portion of the housing 140 toward the one end portion thereof (hereinafter, referred to as "flow path ④"). The water, at the other end portion of the housing 140, is discharged to the outside through the outlet hole 144.

As for a heating method, water flowing through flow path ① and flow path ② is heated by the first ceramic plate 122. In detail, water flowing through flow path ① is heated by one surface of the first ceramic plate 122, and water flowing through flow path ② is heated by the other surface of the first ceramic plate 122. The same amount of heat is radiated from both surfaces of the first ceramic plate 122 and therefore water in flow path ① and flow path ② is heated by the same amount of heat. Meanwhile, water flowing through flow path ③ and flow path ④ is heated by the second ceramic plate 124. In detail, water flowing through flow path ③ is heated by one surface of second ceramic plate 124, and water flowing through flow path ④ is heated by the other surface of the second ceramic plate 124. Since the same amount of heat is radiated from both surfaces of the second ceramic plate 124, water in flow path ③ and flow path ④ is heated by the same amount of heat.

Water, introduced through the inlet hole 142, is heated by coming into contact with all of the surfaces of the two ceramic plates 122 and 124 while flowing through flow paths ①, ②, ③ and ④. Thus, efficient heat transfer is carried out without wasting heat. That is, water is pushed upwardly and then discharged, without being discharged directly, since the first and second ceramic plates 122 and 124 are installed vertically and the outlet hole 144 is disposed in the upper portion. Accordingly, water receives heat while contacting all of the surfaces of the first and second ceramic plates 122 and 124.

The highly efficient heat transfer from the first and second ceramic plates 122 and 124 may generate and grow fine bubbles. If the fine bubbles are attached to the surfaces of the ceramic plates 122 and 124, the ceramic plates 122 and 124 may be over-heated locally and thus may cause temperature variations brining about thermal impact damaging the ceramic heater.

In this respect, according to the present invention, the flow paths are formed such that their widths are widened from the inlet hole 142 toward the outlet hole 144. Referring to FIGS. 4 and 5, the relation of $t1<t2<t3<t4$ is formed, where $t1$ denotes the width of flow path ①, $t2$ denotes the width of flow path ②, $t3$ denotes the width of flow path ③, and $t4$ denotes the width of flow path ④. The flow paths, widened from the inlet hole 142 toward the outlet hole 144, increase the flow rate of water that is initially introduced through the inlet hole 142, so that this high flow rate of water can contribute to suppressing the growth of bubbles (i.e., the gathering of fine bubbles) and discharging generated bubbles. Accordingly, the local over-heating of the ceramic heater, caused by bubbles, can be obviated to thereby prevent the ceramic heater from being damaged. As shown in FIG. 5, the generated bubbles can be easily discharged through a gap G formed between the housing 140 and the upper ends of the ceramic plates 122 and 124.

As shown in FIG. 6, the outlet hole 144 is disposed higher than the inlet hole 142 to thereby allow bubbles to escape through the higher side (i.e., toward the outlet hole 144). Accordingly, the ceramic heater can be prevented from being overheated locally due to bubbles.

Figure 7:
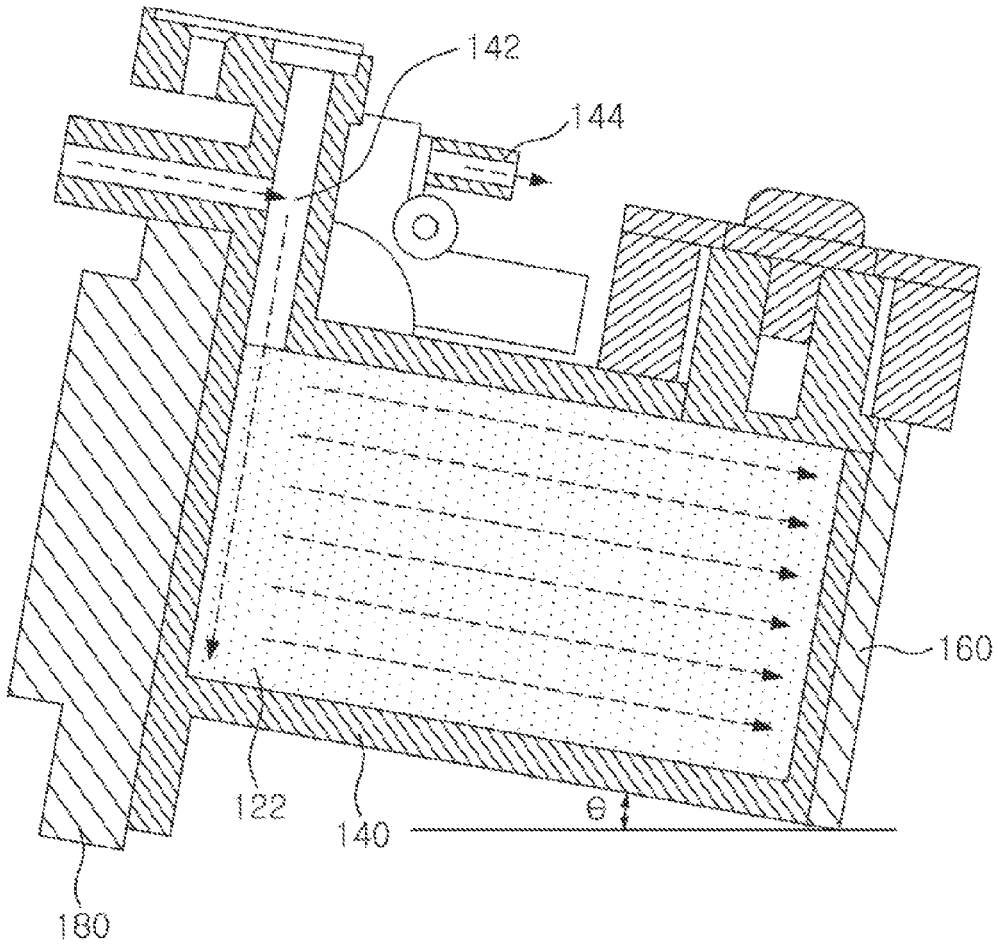
FIG. 7 is a cross-sectional view illustrating the side portion of a heating apparatus according to another exemplary embodiment of the present invention.

As shown in FIG. 7, the heating apparatus 100, when installed, may be inclined at a predetermined angle. That is, the heating apparatus 100 may be inclined such that the side of the outlet hole 144 is placed at the upper portion. In this way, bubbles generated within the heating apparatus 100 can come out through the outlet hole 144, thereby obviating thermal impact. Although not shown, in order to allow bubbles to smoothly come out of the upper portion, the outlet hole 144 needs to be opened in a direction opposite to a direction in which the outlet hole 144 is opened in FIG. 6, that is, toward the upper portion (the left upper portion in the drawing).

As for a mechanism for preventing damage to the ceramic plates 122 and 124 due to bubbles, the ceramic plates 122 and 124 are disposed inside the housing 140, and water introduced through the inlet hole 142 flows flow path ①, flow path ②, flow path ③ and flow path ④ formed by the housing 140, the first and second ceramic plates 122 and 124 and the partition wall 162, and then is discharged through the outlet hole 144.

As shown in FIGS. 4 and 5, the ceramic plates 122 and 124 are disposed to stand upright in a parallel manner. Thus, when a fluid (i.e., water) flows along flow path ①, flow path ②, flow path ③ and flow path ④, bubbles, generated due to the heating of the ceramic plates 122 and 124, move upward to the upper portions of the edge regions A (see FIG. 3) of the ceramic plates 122 and 124.

Thereafter, bubbles, generated by the heating of the ceramic plates 122 and 124, are discharged through the outlet hole 144, together with a fluid having passed through flow path ①, flow path ②, flow path ③ and flow path ④.

In such a manner, contact between the ceramic plates 122 and 124 and the bubbles, generated by the heating of the first and second ceramic plates 122 and 124, can be suppressed. Furthermore, even if bubbles, generated by the heating of the ceramic plates 122 and 124, come into contact with the upper portions of the edge regions A of FIG. 3, damage to the first and second ceramic plates 122 and 124 can be suppressed since no heating wire 123 is disposed in the edge regions A.

In detail, thermal impact causes damage to the ceramic plates 122 and 124. If heat exchange occurs between air, not water, and the first and second ceramic plates 122 and 124, heat transfers to the air to a lesser extent than the case in which heat transfers to water. Therefore, portions of the first and second ceramic plates 122 and 124 exchanging heat with the air are overheated as compared to other portions of the first and second ceramic plates 122 and 124 exchanging heat with water, thereby causing a temperature variation. Here, the term 'thermal impact' refers to impact applied by this temperature variation.

However, according to an exemplary embodiment of the present invention, bubbles, although generated from the heating surface, can move toward the upper portions of the edge regions A of the ceramic plates 122 and 124 since the ceramic plates 122 and 124 are installed vertically within the housing 140 and air bubbles have smaller specific gravity than water.

Thereafter, the bubbles, having moved toward the upper portions of the edge regions of the first and second ceramic plates 122 and 124, are placed between the housing 140 and the upper ends of the ceramic plates 122 and 124, thereby preventing the bubbles from contacting the ceramic plates 122 and 124. Accordingly, the ceramic plates 122 and 124 can be prevented from being damaged by thermal impact.

Furthermore, the ceramic plates 122 and 1244 each have an edge region A in which the heating wire 123 is not disposed. Accordingly, even if bubbles grow and come into contact with the edge of the ceramic plates 122 and 124, the bubbles contact the edge region A where the heating wire 123 is not disposed. Accordingly, a reduction in thermal impact applied to the first and second ceramic plates 122 and 124 can be achieved.

A higher level of power may be applied to the second ceramic plate 124 disposed adjacent to the outlet hole 144 than to the first ceramic plate 122 disposed adjacent to the inlet hole 142. For example, a power of 300 watts may be applied to the first ceramic plate 122 while a power of 700 watts is applied to the second ceramic plate 124. Thus, water is initially heated to a certain temperature by the heat of a relatively low temperature generated from the first ceramic plate 122 near the inlet hole 142. Thereafter, the water, when passing the second ceramic plate 124, is heated to a set temperature and finally discharged through the outlet hole 144.

That is, the first ceramic plate 122 serves to adjust a temperature within a relatively small range, while the second ceramic plate 124 serves to adjust a temperature within a relatively wide range. Therefore, efficient heat transfer and a reduction in power consumption can both be achieved.

Fixed power is applied to the first ceramic plate 122 since it is important for the first ceramic plate 122 to raise a water temperature to a certain level. Also, variable power is applied to the second ceramic plate 124 since it is important for the second ceramic plate 124 to adjust the water temperature up to a target temperature. Such power control is carried out by a controller.

As set forth above, according to exemplary embodiments of the invention, water, introduced through the inlet hole, flows through a flow path formed in a zigzag shape and thus is heated by contacting all of the surface of the two ceramic plates, thereby achieving efficient heat transfer without wasting heat and preventing thermal impact caused by bubble generation.

Furthermore, the first ceramic plate is used to adjust a temperature within a relatively small range, while the second ceramic plate is used to adjust a temperature within a relatively wide range, thereby achieving efficient heat transfer and reducing power consumption.

While the present invention has been shown and described in connection with the exemplary embodiments, it will be apparent to those skilled in the art that modifications and variations can be made without departing from the spirit and scope of the invention as defined by the appended claims.

What is claimed is:

1. A heating apparatus comprising:

a ceramic heater including a plurality of ceramic plates having a plate shape; and a housing including an inlet hole and an outlet hole, the housing in which the ceramic heater is installed, the outlet hole being disposed higher than the inlet hole, wherein the ceramic plates are disposed vertically in the housing in a parallel manner and the outlet hole is disposed in an upper portion of the housing such that when a fluid flows through a flow path formed along the ceramic plates, bubbles, generated by the fluid heated by the ceramic plates, ascend toward upper edges of the ceramic plates, wherein the ceramic plates are fixed to a fixing member disposed at a first side of the housing, wherein a gap is defined between upper ends of the ceramic plates and the housing such that the bubbles ascending towards the upper edges of the ceramic plates are placed in the gap before discharging through the outlet hole, thereby preventing the bubbles from contacting the ceramic plates, wherein the heating apparatus is inclined such that a side of the outlet hole is placed at the upper portion to allow the bubbles generated by the fluid by heating to be discharged through the outlet hole.

2. The heating apparatus of claim 1, wherein the ceramic heater comprises:

a first ceramic plate disposed adjacent to the inlet hole; and a second ceramic plate disposed adjacent to the outlet hole, wherein a partition wall is installed between the first ceramic plate and the second ceramic plate.

3. The heating apparatus of claim 2, wherein the first ceramic plate and the second ceramic plate are attached to the first side of the housing and spaced apart from a second side of the housing, and the partition wall is attached to the second side of the housing and spaced apart from the first side thereof.

4. The heating apparatus of claim 1, wherein the flow path is widened from the inlet hole toward the outlet hole.

5. The heating apparatus of claim 1, wherein the ceramic plates have an area that is greater than a cross-section of the flow path.

6. The heating apparatus of claim 1, wherein heating wires are installed inside the ceramic plates and disposed at the center of the ceramic plates in a thickness direction, respectively.

7. The heating apparatus of claim 2, wherein power applied to the first ceramic plate is different from power applied to the second ceramic plate.

8. The heating apparatus of claim 7, wherein the power applied to the second ceramic plate is higher than the power applied to the first ceramic plate.

9. The heating apparatus of claim 7, wherein fixed power is applied to the first ceramic plate and variable power is applied to the second plate.

* * * * *